US007712849B2

(12) United States Patent
Jakins et al.

(10) Patent No.: US 7,712,849 B2
(45) Date of Patent: May 11, 2010

(54) ADAPTABLE BI-FOLD SCRAPBOOK AND CRAFT WORKSTATION

(76) Inventors: Glenn Jakins, 226 E. 2100 North, Provo, UT (US) 84604; Darin Davis, 131 E. Smithridge, Lehi, UT (US) 84043; Garth Hubert, 269 N. 1080 East, Provo, UT (US) 84806

( * ) Notice: Subject to any disclaimer, the term of this patent is extended or adjusted under 35 U.S.C. 154(b) by 0 days.

(21) Appl. No.: 11/811,369

(22) Filed: Jun. 7, 2007

(65) Prior Publication Data

US 2008/0030002 A1 Feb. 7, 2008

Related U.S. Application Data

(60) Provisional application No. 60/811,497, filed on Jun. 7, 2006.

(51) Int. Cl.
*A47B 77/10* (2006.01)

(52) U.S. Cl. ..... 312/314; 312/310; 312/317.3

(58) Field of Classification Search ..... 312/314, 312/313, 321.5, 317.1, 317.3, 311, 291, 310, 312/258, 292, 326, 329, 240; 220/6
See application file for complete search history.

(56) References Cited

U.S. PATENT DOCUMENTS

| | | | | | |
|---|---|---|---|---|---|
| 122,337 | A * | 1/1872 | Thompson | 312/224 |
| 155,604 | A * | 10/1874 | Wooton | 312/199 |
| 888,104 | A * | 5/1908 | Lind | 312/300 |
| 1,027,816 | A * | 5/1912 | Cassity | 312/200 |
| 1,099,521 | A | 6/1914 | Sprung | |
| 1,308,702 | A * | 7/1919 | Fellheimer | 312/50 |
| 1,559,705 | A * | 11/1925 | Jackson | 312/305 |
| 1,700,924 | A * | 2/1929 | Cushman | 312/277 |
| 1,749,686 | A * | 3/1930 | Agazzi | 312/225 |
| 1,943,282 | A * | 1/1934 | Bellavia | 312/222 |
| 2,813,769 | A * | 11/1957 | Post | 312/258 |
| 3,282,634 | A * | 11/1966 | Marcus | 312/199 |
| 4,502,742 | A * | 3/1985 | Neff | 312/324 |
| 4,669,790 | A * | 6/1987 | Briggs | 312/223.3 |
| 4,676,570 | A * | 6/1987 | Pincherri | 439/148 |
| 4,874,119 | A * | 10/1989 | Winter | 224/610 |
| 5,121,974 | A | 6/1992 | Monson | |
| D376,491 | S | 12/1996 | Kelley | |
| D376,496 | S | 12/1996 | Kelley et al. | |
| 5,590,940 | A | 1/1997 | Richard | |
| 5,678,905 | A | 10/1997 | Kelley | |
| 5,695,264 | A | 12/1997 | Koch | |
| 5,738,422 | A | 4/1998 | Welborn, Jr. et al. | |
| 5,842,758 | A | 12/1998 | Kelley | |
| 5,927,833 | A | 7/1999 | Kelley | |
| D440,429 | S * | 4/2001 | Wales et al. | D6/446 |
| 6,692,092 | B1 * | 2/2004 | Evans | 312/311 |
| 7,261,384 | B1 * | 8/2007 | Craft et al. | 312/235.3 |
| 2004/0262307 | A1 * | 12/2004 | DeCarlo et al. | 220/6 |
| 2005/0029261 | A1 * | 2/2005 | Sheng-Bin | 220/9.1 |

FOREIGN PATENT DOCUMENTS

| | | |
|---|---|---|
| FR | 2650494 | 2/1991 |

* cited by examiner

*Primary Examiner*—James O Hansen
(74) *Attorney, Agent, or Firm*—Holland & Hart LLP

(57) ABSTRACT

A scrapbook workstation includes a base workstation member including a first plurality of adjustable shelves, at least one bi-fold door rotatably coupled to the base workstation, and a collapsible table rotatably coupled to the base workstation member, wherein the at least one bi-fold door further comprises a second plurality of adjustable shelves formed in a first panel and a coupling board formed on a second panel.

20 Claims, 9 Drawing Sheets

ADAPTABLE BI-FOLD SCRAPBOOK AND CRAFT WORKSTATION

RELATED APPLICATIONS

This application claims the benefit under 35 U.S.C. §119 (e) of U.S. Provisional Patent Application No. 60/811,497 filed Jun. 7, 2006 titled "Adaptable Bi-Fold Scrapbook Workstation", which application is incorporated herein by reference in its entirety.

FIELD

The present system and methods relate to a scrapbook and craft workstation, and more specifically, a scrapbook workstation configured to appear as a fine piece of furniture while maximizing available space for the storage of scrapbook materials.

BACKGROUND

Compiling scrapbooks or picture albums of memories or artwork has been a tradition in family homes for centuries. There are two common complaints about assembling scrapbooks. One complaint is that there is not enough room to make and work on a scrapbook. Another complaint involves getting all the tools and associated components out to work on the scrapbook or craft and putting it all away each time a person has finished working on their scrapbook, which can be very time consuming.

The following design patents illustrate ornamental designs of various desks. U.S. Des. Pat. No. 376,491, issued to James O. Kelley on Dec. 17, 1996, illustrates a computer secretary. The ornamental design includes two separate compartments enclosed by four doors. The compartments include shelves, drawers, and a work surface, but does not include a bifolding door. U.S. Des. Pat. No. 376,496, issued to Kelly, et al. on Dec. 17, 1996, illustrates a computer workplace having one major compartment enclosed by two doors, not bi-fold doors.

The following patents disclose various types of desks and work stations. U.S. Pat. No. 1,099,521, issued to Abbe Sprung on Jun. 9, 1914, describes an office desk including a pigeon hole rack in which letters or papers may be quickly filed. It has an ordinary flat top desk which may raise the pigeon hole rack by a trip element actuated by the operator.

U.S. Pat. No. 5,121,974, issued to Alan R. Monson on Jun. 16, 1992, describes a computer desk apparatus with parallel walls formed with a front wall defining a central cavity. The central cavity is positioned between a right series of storage drawers and a left storage door positioned hingedly in front of a printer cavity which further includes a medially positioned slide-out drawer. Extending upwardly from a lower desk plate are right and left storage shelves. The upper cavity includes a roll-top member directed over the cavity to provide protection for the organization when not in use.

U.S. Pat. No. 5,590,940, issued to Michael B. Richard on Jan. 7, 1997, describes a sliding rack cabinet for dressers. The cabinet includes a rectilinearly shaped cabinet member having a peripheral edge wall. The back wall is connected to and spanning the peripheral edge wall. A tie is rack mounted to the peripheral edge wall adjacent to the top edge wall.

U.S. Pat. No. 5,695,264, issued to David T. Koch on Dec. 9, 1997, describes a portable office unit with an enclosure that includes two hingedly connected shells. U.S. Pat. No. 5,738,422, issued to Welborn, Jr. et al. on Apr. 14, 1998, describes a computer work station which includes a first desk unit with a front tapered edge. The first desk unit has an electrical control panel with surge protected outlets. The work station has a second desk unit, one end of the second desktop being inserted into and supported by a support rail in a bookcase and the other end being placed upon and secured to a file cabinet.

U.S. Pat. No. 5,842,758, issued to James O. Kelley on Dec. 1, 1998, describes a sky cabinet work station having a pair of opposing side panels which have vertically oriented elongated members. The top includes a transparent or translucent panel which is adapted to transmit light through the panel to illuminate the work station.

U.S. Pat. No. 5,678,905, issued to James O. Kelley on Oct. 21, 1997, and U.S. Pat. No. 5,927,833, issued to James O. Kelley on Jul. 27, 1999, both describes a concealed desk which comprises a desktop or work surface with supporting side panels, a kneehole opening, and storage compartments. The front of the desk is enclosable by folding doors mounted on front side edges of the desk's side panels.

When the doors are opened, the doors preferably fold against the side panels of the desk and do not obstruct either the appearance or the use of the desk. The desktop surface of the desk is concealed by an upper storage unit that is mounted on the desktop or that comprises an extension of the desk, above the desktop or work surface. Full lengths doors enclose both the upper and lower portions of the desk to give the furniture the appearance of an armoire. French Pat. No. 2,650,494, published Feb. 8, 1991, describes a work place for a computer having lower shelving and storage units.

With the increasing popularity of showcasing photos and memorabilia in attractive keepsake albums and scrapbooks, the need for a compact space saving workstation that is visually attractive has increased. However, due to the space needed for scrapbook and photo album work, the traditional workstations mentioned above are unable to accommodate the need for space.

SUMMARY

In one of many possible embodiments, the present exemplary bi-fold scrap book and craft workstation includes an armoire type structure including a plurality of bi-fold doors configured to store scrapbook tools and materials. Additionally, the armoire type structure includes a collapsible table therein that not only saves space, but also provides a useable workspace.

According to another exemplary embodiment, the present exemplary bi-fold scrapbook and craft workstation includes a plurality of collapsible bins configured to be collapsed into a single planar geometry for ease of shipping and storing.

According to yet another exemplary embodiment, the present exemplary bi-fold scrap book and craft workstation includes a number of coupling pouches that may be vertically arranged on one of the panels of the bi-fold door.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

The present specification describes a scrapbook and craft workstation configured to meet the storage, accessibility, aesthetics, and work space specifications desired for assembling scrapbooks. While the present exemplary workstation may be used to efficiently store any number of materials for any number of purposes including scrapbooking, craft making, and the like, for ease of explanation only, the present exemplary system and method will be described in the context of a scrap book or a picture album workstation.

As mentioned previously, there have been developed a number of traditional desks and workstations. However, normal sized shelves and drawers cannot accommodate the various large sizes of scrapbooks, paper, and equipment used in preparing scrapbooks. Additionally, due to the high quantity of small stamps, punches, brads, rivets, and other decorative elements often associated with scrapbooking, the number of available storage locations in traditional desks and workstations are not sufficient. An ideal work surface would include a large sized work surface with drawers specifically constructed to hold various sized scrapbooks and items. In addition, due to the large quantity of materials and tools needed for scrapbooking, traditional opaque drawers are inconvenient and make it difficult to find a desired tool, paper, or the like. Furthermore, According to the present exemplary system and method, the present exemplary scrapbook workstation includes a number of advantageous features including, but in no way limited to, a plurality of bi-fold doors for maximizing storage space when open and minimizing storage space when not in use. Additionally, the present exemplary scrapbook workstation includes a plurality of adjustable coupling pouches and collapsible bins configured to allow for customizing of the workstation while minimizing shipping packaging and volume. Further details of the present exemplary scrapbook workstation will be provided below with reference to the Figures.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Figure 1A:
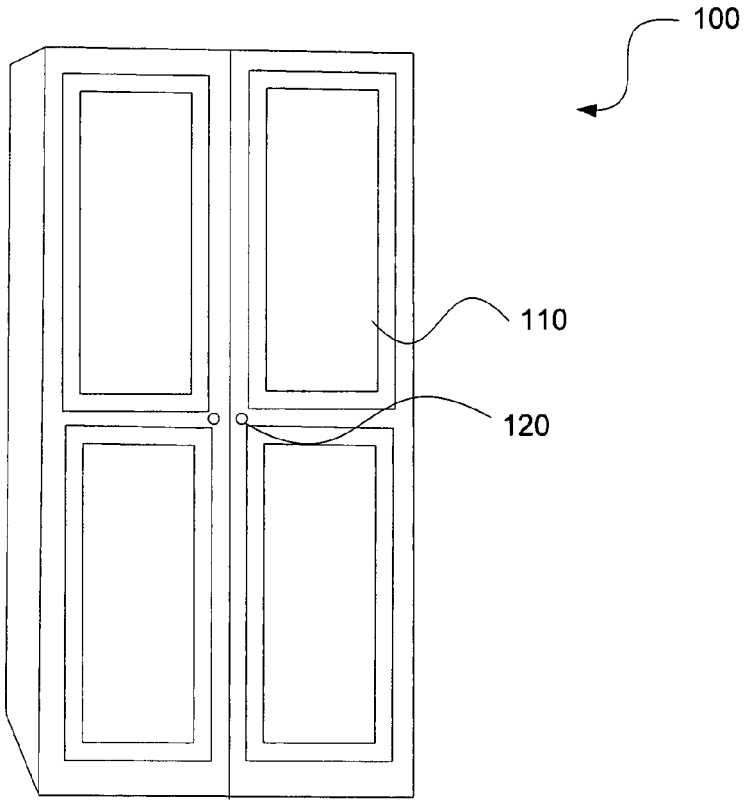
FIG. 1A is a frontal view of a scrapbook and craft workstation in a closed position, according to one exemplary embodiment.

As mentioned, FIGS. 1A though 1E illustrate various views of the present exemplary scrapbook workstation (100), according to one exemplary embodiment. As illustrated in FIG. 1A, when closed, the scrapbook workstation (100) includes a plurality of bi-fold doors (110) including one or more handles (120) to facilitate the opening thereof. Additionally, an elegant wood paneling design is formed on the outside of each bi-fold door to add to the aesthetics of the workstation (100). While illustrated with raised panels, the design of each bi-fold door (110) may be modified to assume any number of designs. As shown, the workstation (100) assumes the form of an armoire. According to one exemplary embodiment, the bi-fold doors (110) and the scrapbook workstation (100) in general may be made of any number of materials including, but in no way limited to, wood, plastic, metal, composites, and/or combinations thereof.

Figure 1B:
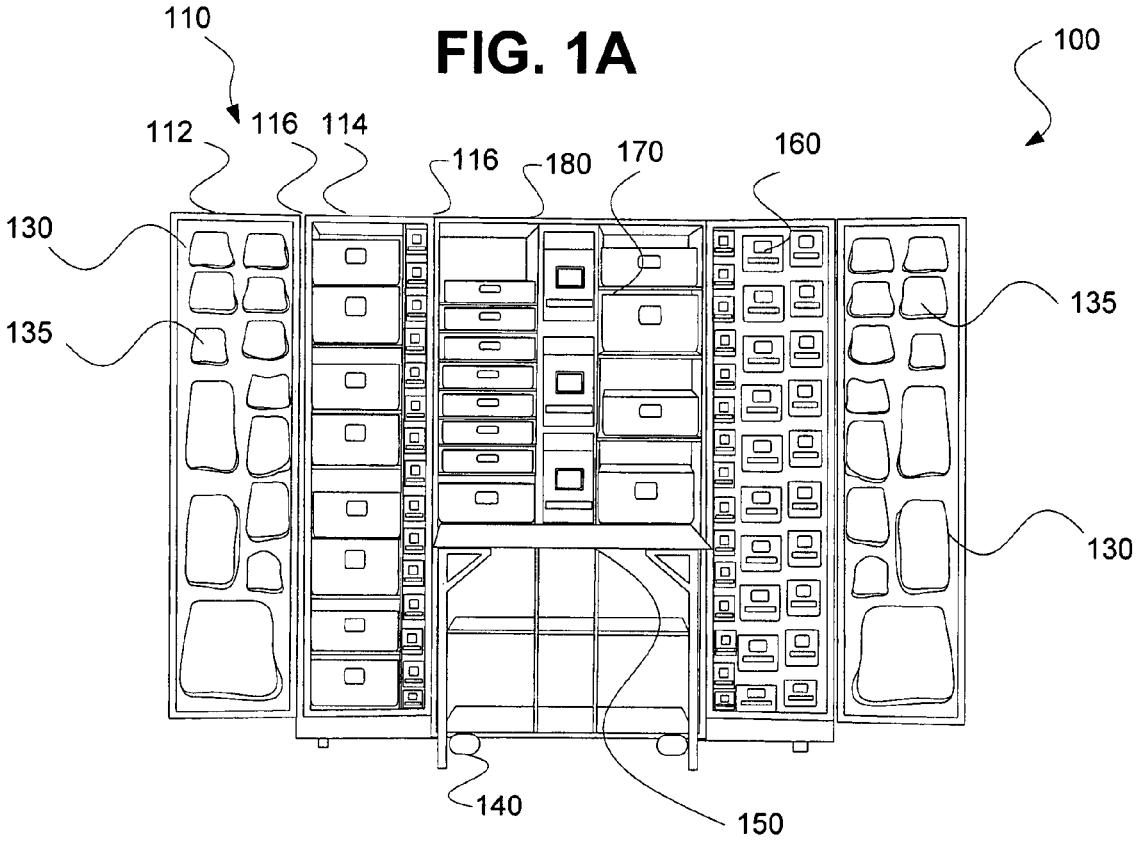
FIG. 1B is a frontal view of a scrapbook and craft workstation in an open position, according to one exemplary embodiment.
Figure 1C:
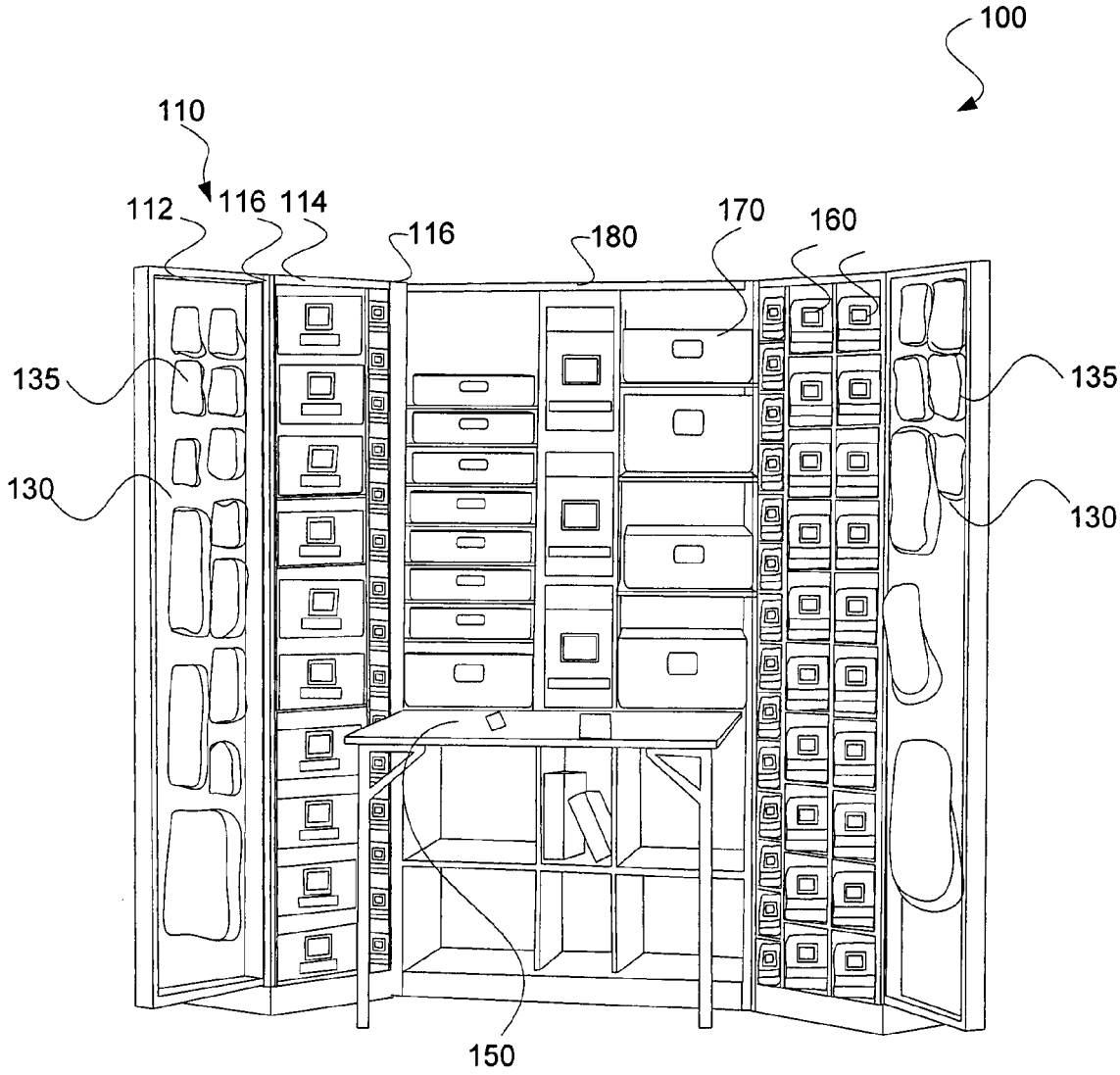
FIG. 1C is a perspective view of a scrapbook and craft workstation in an open position, according to one exemplary embodiment.

As demonstrated by FIGS. 1B and 1C, the bi-fold doors (110) may be opened to provide access to the storage capacity of the scrapbook workstation (100). As illustrated, the bi-fold doors (110) include an interior panel (112) and an exterior panel (114) coupled together by a rotatable member (116) such as one or more hinges. According to one exemplary embodiment, the rotatable member (116) includes a piano hinge. Additionally, the bi-fold door (110) is coupled to the body (180) of the scrapbook workstation (100) by a rotatable member (116) such as a piano hinge. According to one exemplary embodiment, the body (180) of the present exemplary scrapbook workstation (100) includes a bottom member, a plurality of vertical side and back members, and a top member. Additionally, a number of adjustable shelves (170) may be formed in the body (180) of the scrapbook workstation (100), as will be described in further detail below. While the present exemplary system is described as being connected by a plurality of rotatable members (116) in the form of piano hinges, any number of rotatable members may be used including, but in no way limited to, a plurality of traditional hinges, a compliant rotational member, a bendable polymer strip, and the like.

Figure 1D:
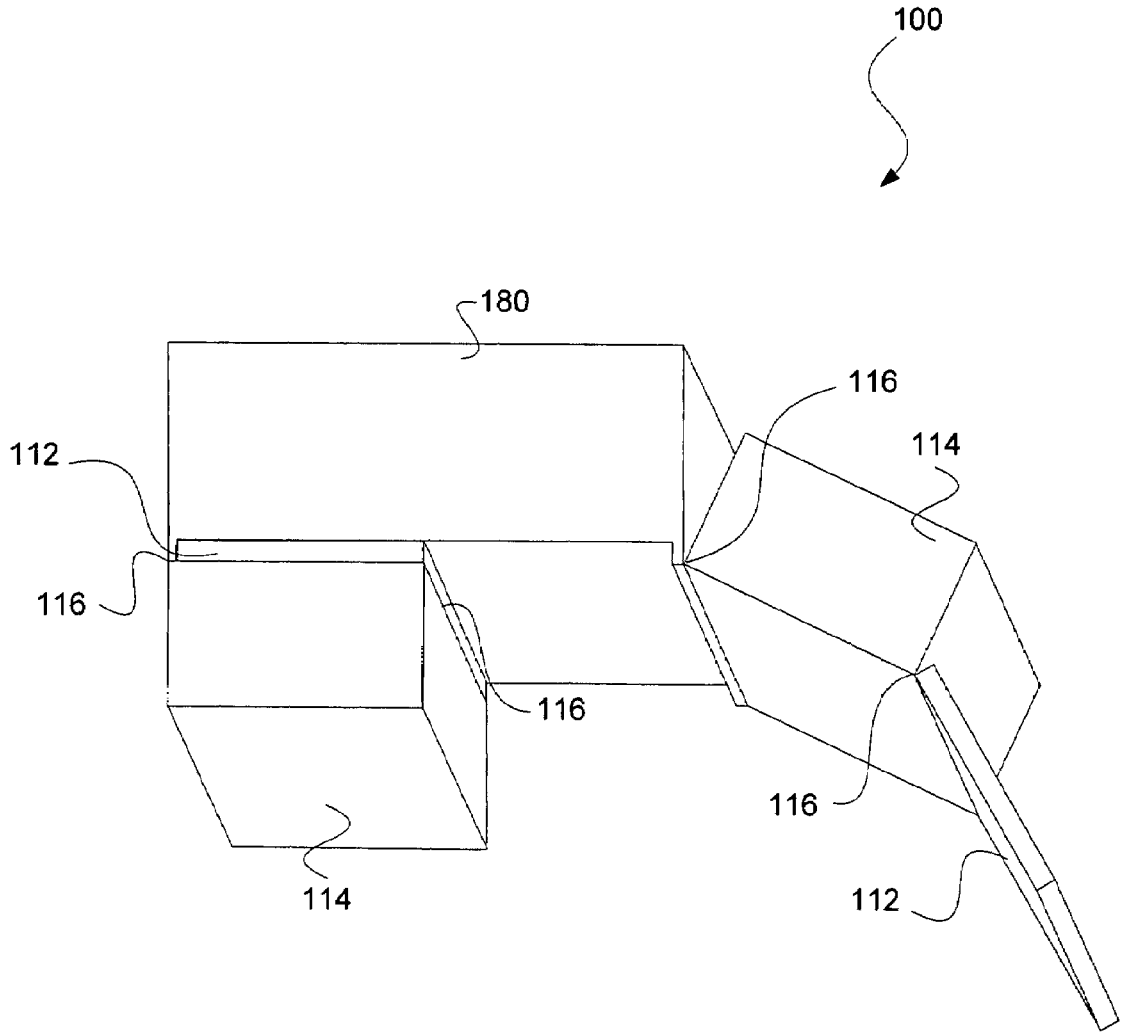
FIG. 1D is a top perspective view of a scrapbook and craft workstation in a partially open position, according to one exemplary embodiment.

FIG. 1D illustrates how the interior panel (112) and an exterior panel (114) are coupled together about the rotatable member (116) to form a compact and space saving design. As illustrated, the interior panel (112) rotates about the rotatable member (116) until it is flush against the exterior panel (114). Once the interior panel (112) is flush with the exterior panel (114), both panels may be rotated about another rotatable member (116) until they are both flush with the body (180) of the scrapbook workstation (100). As illustrated, a rabbit or other protrusion may be formed on the body (180) of the scrapbook workstation (100) where the rotatable member (116) couples the exterior panel (114) to the body. According to one exemplary embodiment, the rabbit or protrusion extends from the body (180) a distance substantially equal to the width of the interior panel (112). By matching the width of the interior panel (112) with the width of the protrusion, the entire member formed by the exterior panel (114) and the interior panel (112) can be seated flush with the body (180) of the scrapbook workstation (100) when in a closed position.

Returning again to FIGS. 1B and 1C, one of either the exterior panel (114) or the inner panel (112) is deep, while the other is substantially flat. According to the illustrated embodiment, the exterior panel (114) is the deep panel to facilitate the reception of adjustable shelves (170) and any number of collapsible bins (160). Further, in contrast to the deep panel, the substantially flat panel, or the inner panel (112) in the illustrated embodiment, includes a coupling surface (130) configured to adhere any number of coupling pouches (135) thereto. According to one exemplary embodiment detailed below, the coupling pouches (135) and the coupling surface (130) have mating surfaces forming a hook-and-loop junction. Alternatively, any number of coupling mechanism may be used to attach the coupling pouches (135) to the coupling surface (130) including, but in no way limited to, a metal/magnet interaction, ring and hook interaction, an adhesive interaction, and the like.

Figure 1E:
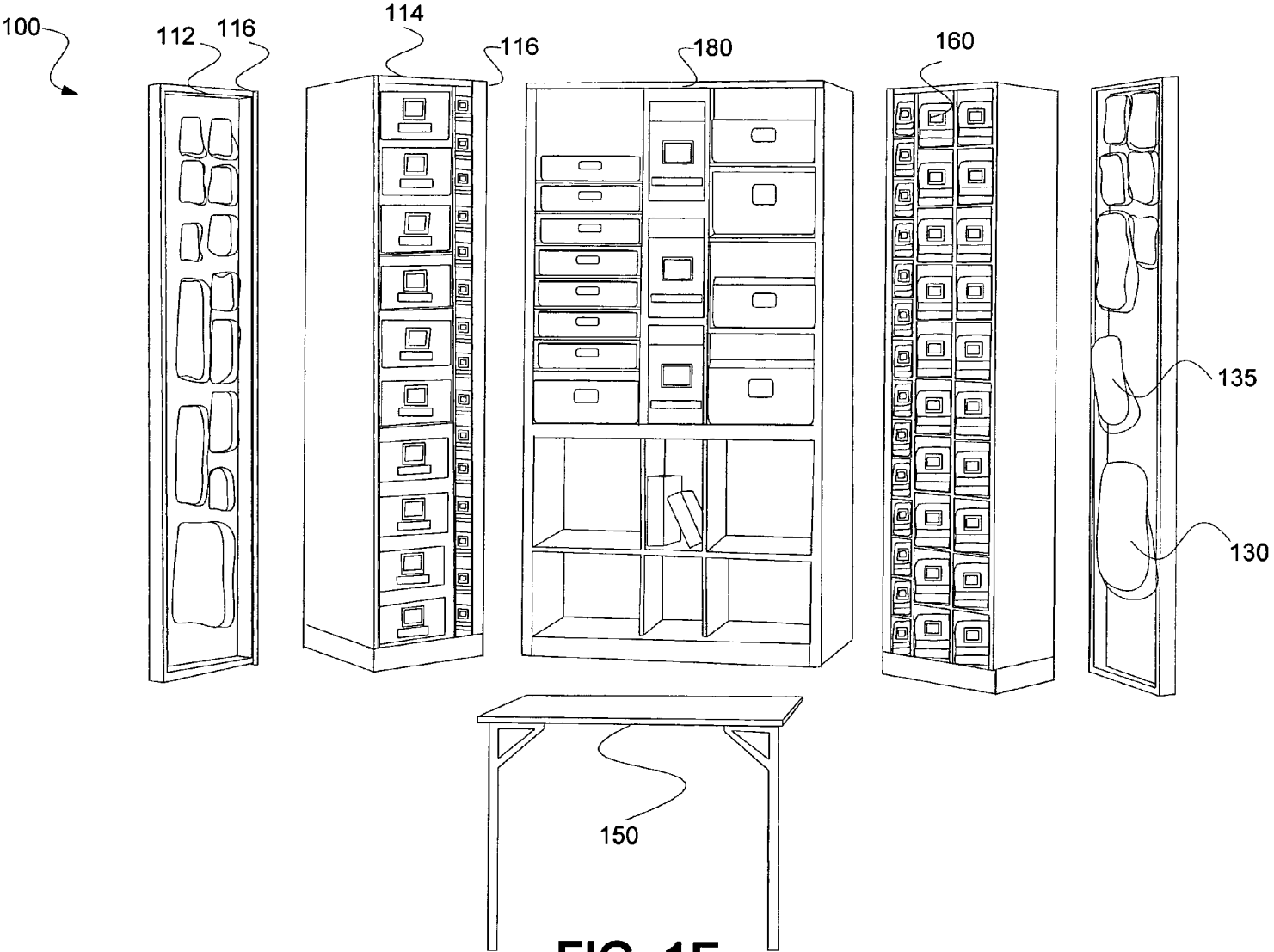
FIG. 1E is an exploded perspective view of a scrapbook and craft workstation in an opened position, according to one exemplary embodiment.

Further, as illustrated in FIGS. 1B, 1C, and 1E, the opening of the bi-fold doors (110) allows for the engagement of a folding table (150) disposed within the scrapbook workstation (100). As shown, the folding table (150) includes a plurality of collapsible hinged legs that may be folded substantially parallel with the working surface of the table (150) when stored. Additionally, the back edge of the working surface is hinged to the main body of the scrapbook workstation (100) such that it may be pivotably rotated in and out of position within the workstation. According to one exemplary embodiment, when the bi-fold doors (110) are opened to grant access to the interior of the workstation (100), the front edge of the folding table (150) may be grasped and pulled upward, allowing the collapsible hinged legs to open and support the working surface. Once opened, the working surface will be supported by the collapsible legs and the hinge member coupling the back edge of the working surface to the main body of the scrapbook workstation (100).

As mentioned, the present exemplary scrapbook workstation (100) includes a number of adjustable shelves (170) configured to house the collapsible bins (160), scrapbook tools, picture boxes, and/or any number of scrapbook or picture albums. According to one exemplary embodiment, the adjustable shelves (170) may be supported in the main body of the scrapbook workstation (100) and the bi-fold door (110) by post and hole system. Specifically, a number of evenly spaced holes may be formed on the inner walls of the main body (180) of the scrapbook workstation (100) and the bi-fold door (110). Corresponding cylindrically shaped pins or posts (not shown) may then be selectively inserted into the holes to provide supports to the shelves. Additionally, a rubberized coating or member may be formed on the posts to increase the friction of the surface, thereby securing the adjustable shelves in the workstation (100). The adjustability of the shelves allows for the shelves to be selectively spaced accommodating any number of album sizes and shapes. Furthermore, the present exemplary workstation (100) may include a number of fixed shelves that provide storage space as well as structural support for the workstation.

According to one exemplary embodiment, the present exemplary scrapbook workstation may also include a surge protected power strip (not shown) integrally wired into the workstation (100). According to this exemplary embodiment, the surge protected power strip may provide a convenient location for a person using the workstation to plug-in electronic devices including, but in no way limited to, computers, printers, radios, televisions, and the like.

In addition to the above-mentioned capabilities, the present exemplary scrapbook workstation (100) may, according to one exemplary embodiment, include a number of wheels (140) coupled to the bottom surface thereof. The wheels (140) support the scrapbook workstation (100) and allow for the workstation (100) to be moveable at the owner's request. Consequently, the scrapbook workstation (100) may be stored in a small out of the way location in a user's home, and may then be wheeled to a convenient location for use.

Figure 2A:
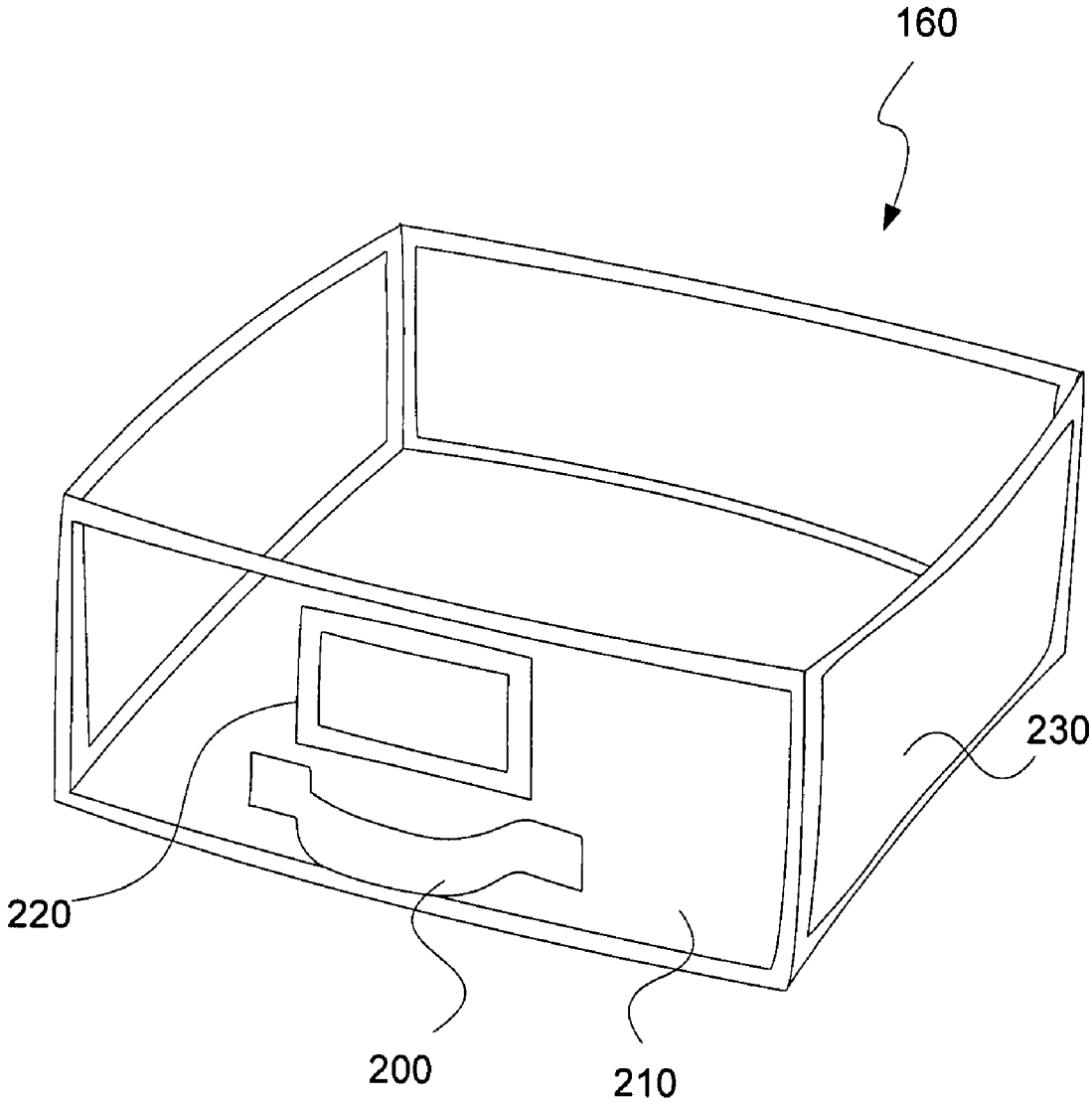
FIG. 2A illustrates an assembled collapsible bin, according to one exemplary embodiment.

FIGS. 2A through 3D further illustrate the collapsible bins, according to one exemplary embodiment. As shown in FIG. 2A, the collapsible bin (160) includes a front panel (210) that is substantially transparent. According to one exemplary embodiment, this allows a user to rapidly locate various items housed in the scrapbook workstation (100). Additionally, the front panel (210) includes a label pouch (220) and a handle (200). During use, a label or other identifier may be placed in the label pouch (220) to facilitate the identification and organization of various scrapbook supplies. Additionally, the handle (200) aids in the selective removal of the collapsible bin (160) during use. The collapsible bin (160) may also include three non-transparent sides (230), according to one exemplary embodiment. The non-transparent sides (230) may be any number of colors and/or materials, including transparent if desired.

Figure 2B:
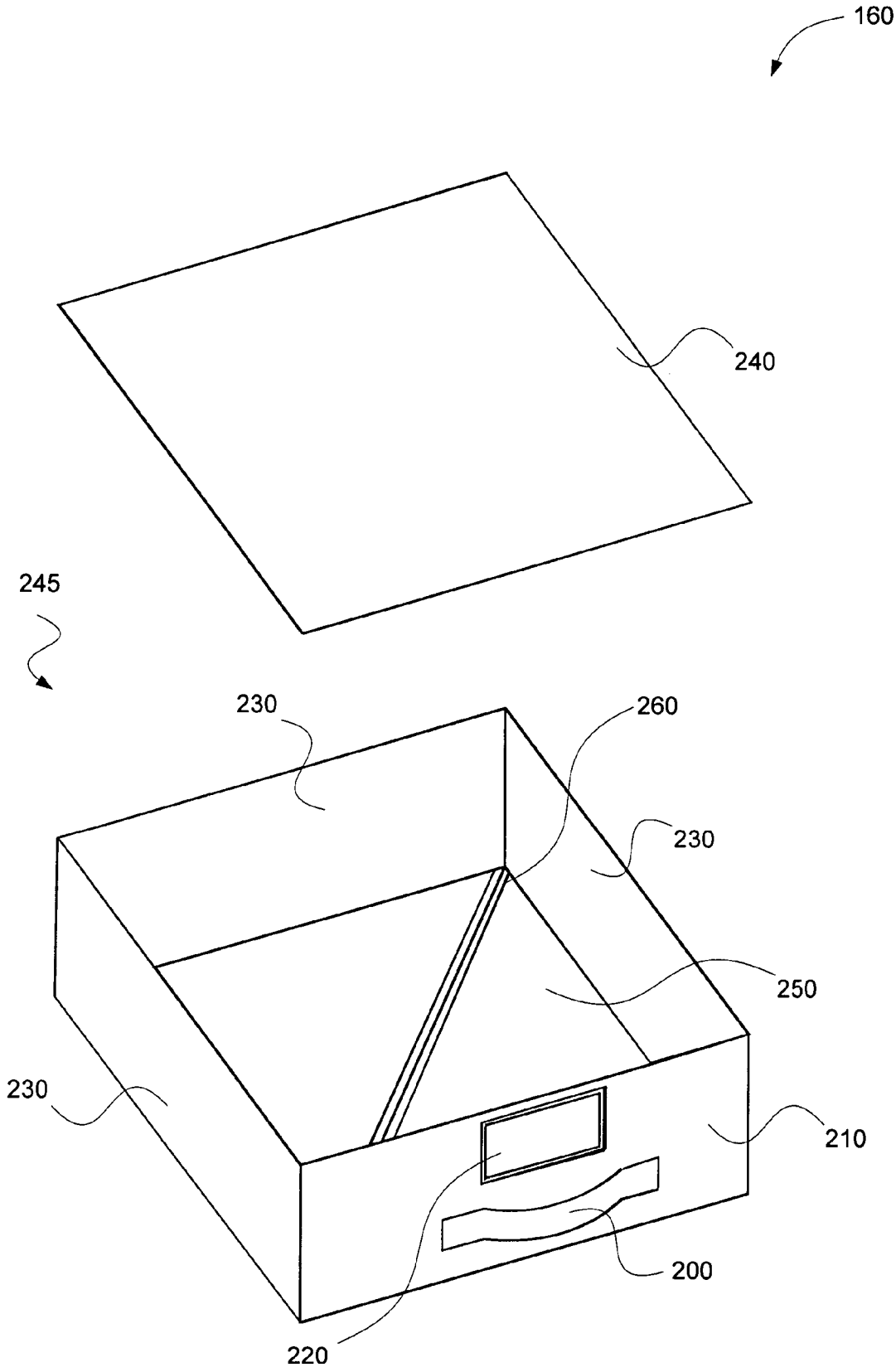
FIG. 2B illustrates an exploded view of a collapsible bin, according to one exemplary embodiment.

FIG. 2B further details the components of the exemplary collapsible bin (160). As shown, the collapsible bin (160) may be separated into a collapsible base (245) portion and a structural bottom panel (240) configured to be disposed within the collapsible base (245). Further, as illustrated in FIG. 2B, the collapsible base (245) includes a collapsible bottom member (250) including a joining seam (260) such as a zipper or a male/female union. According to one exemplary embodiment described in detail with reference to FIGS. 3A through 3D, the two-piece construction allows the collapsible base to be structurally sound when assembled, while providing for disassembly and a planar configuration during storage and shipping.

Figure 3A:
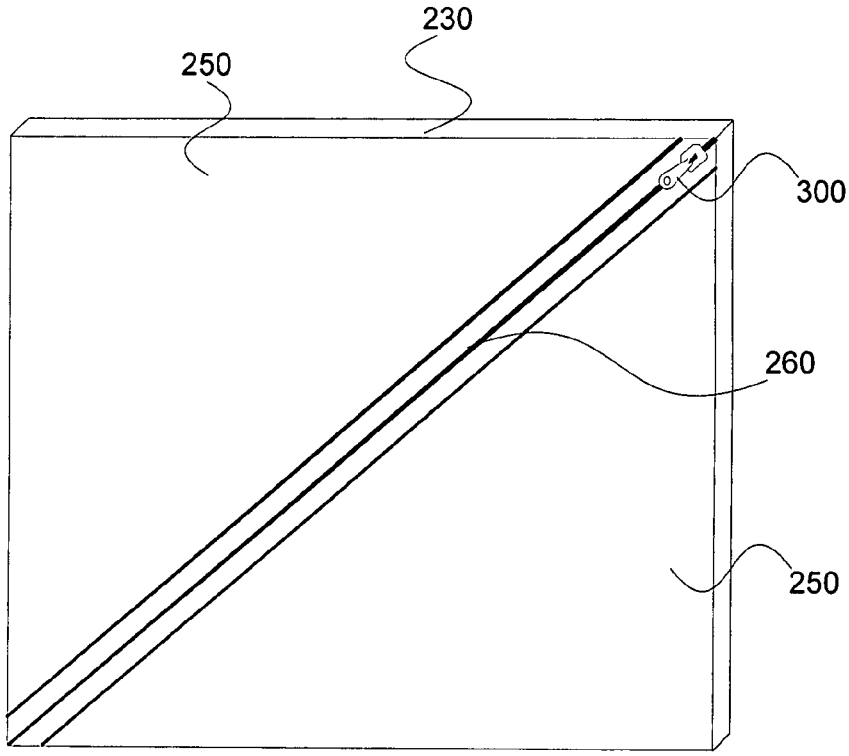
FIGS. 3A through 3D illustrate various views of the collapsible bin being collapsed for storage or transportation, according to one exemplary embodiment.

Specifically, as shown in FIGS. 3A through 3D, the collapsible base (245) may include a joining seam (260) such as a zipper or a male/female coupling including a seam actuator (300). As illustrated in FIG. 3A, the seam actuator (300) may be advanced along the joining seam (260) to close the collapsible bottom (250). When in this position, the front panel (210) and the side panels (230) are positionally constrained by the tension of the collapsible bottom (250).

Figure 3B:
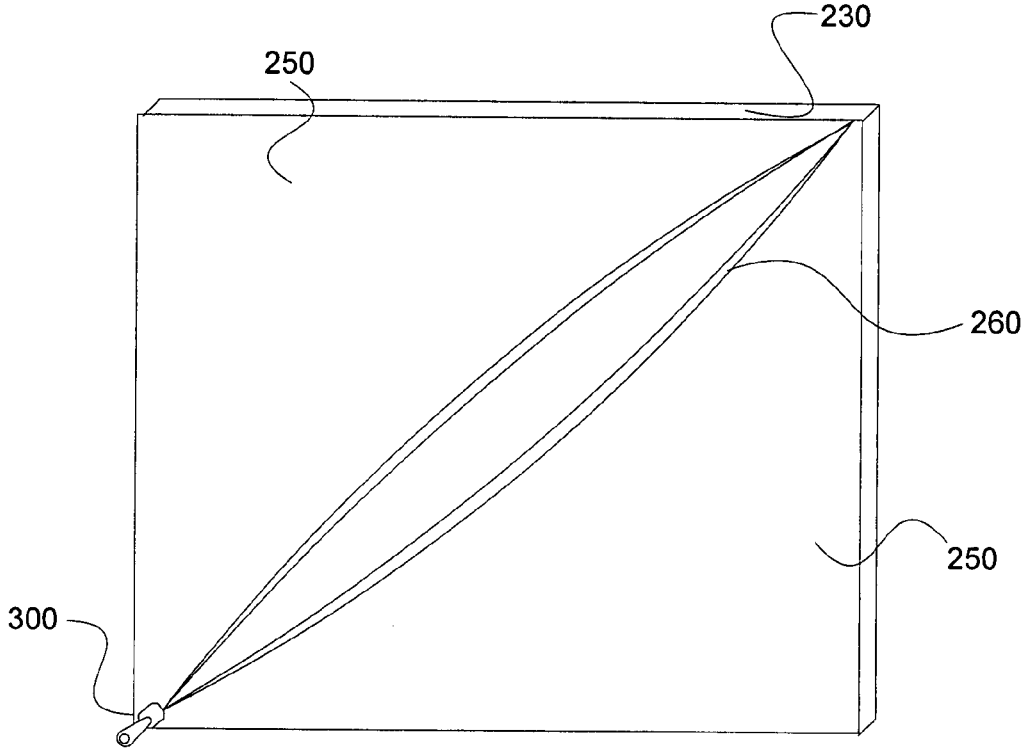

If storage or shipping of the collapsible base (245) is desired, the seam actuator (300) may be actuated, as illustrated in FIG. 3B, causing a separation of the collapsible bottom (250) along the joining seam (260). According to one exemplary embodiment, this reduces the tension of the collapsible bottom (250) and allows for greater freedom of movement of the front panel (210) and the side panels (230).

Figure 3C:
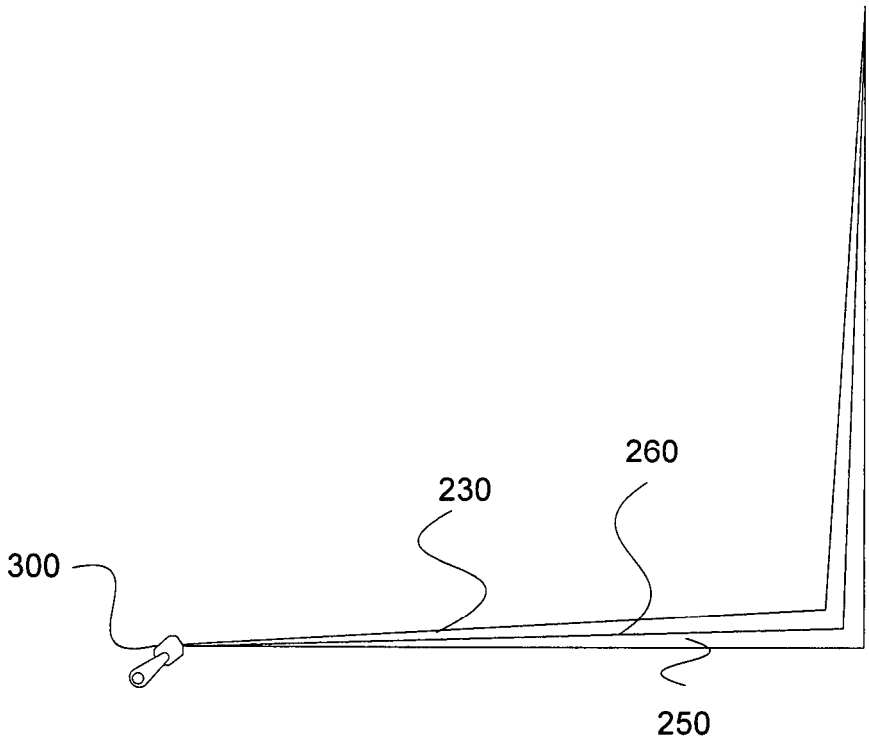
Figure 3D:
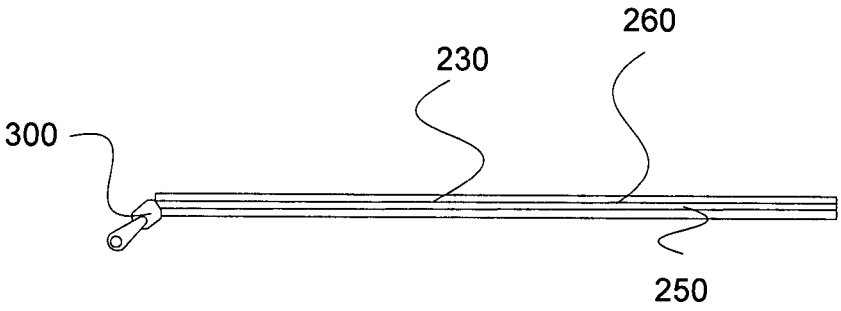

As illustrated in FIGS. 3C and 3D, the increased freedom of movement of the various panels (210, 230), allows for opposing corners to be joined. Specifically, as illustrated in FIG. 3C, two opposing corners may be joined together, forming an "L" shape as shown in FIG. 3C. The entire collapsible base (245) may then be folded along the mating corners, allowing the other two corners to be joined, as illustrated in FIG. 3D. When in this final position, the volume of the collapsible base (245) is minimized and shipping and/or storage of the base is greatly facilitated.

Figure 4A:
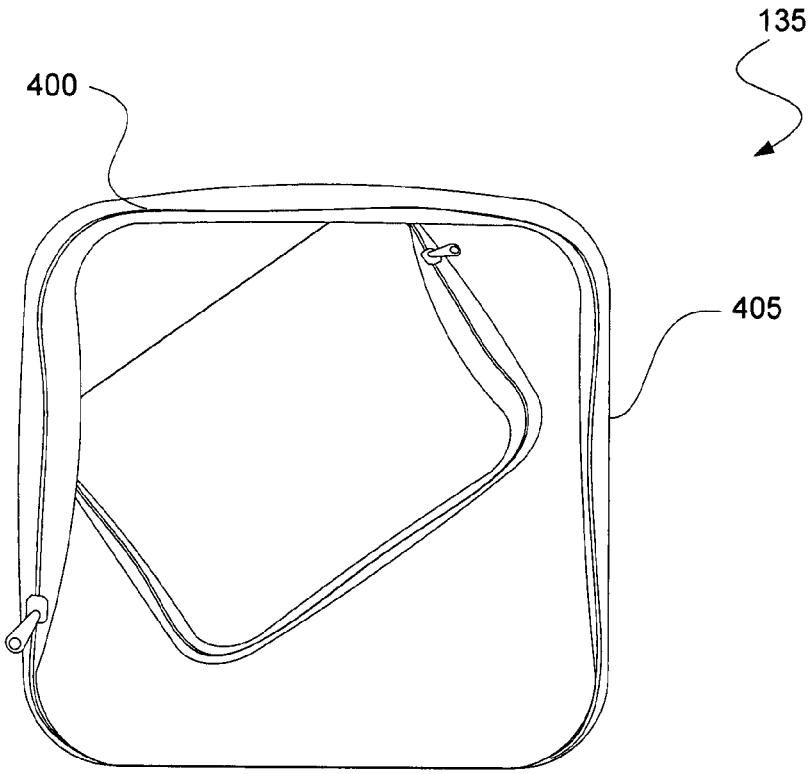
FIGS. 4A and 4B illustrate a frontal and a rear view, respectively, of an adjustable coupling pouch, according to one exemplary embodiment.
Figure 4B:
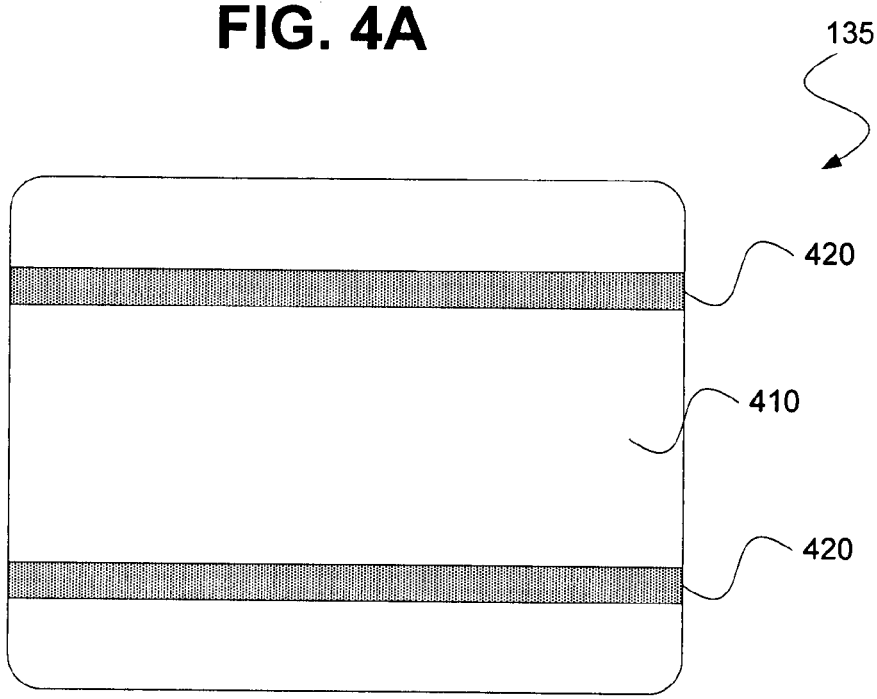

Continuing to FIGS. 4A and 4B, a coupling pouch (135) is illustrated. According to one exemplary embodiment illustrated in FIG. 4A, each coupling pouch (135) includes a substantially transparent front panel (400) and a seam actuator (405) closing the inner volume of the coupling pouch. According to one exemplary embodiment, the seam actuator (405) may include, but is in no way limited to, a zipper, a male/female coupling, buttons, Velcro, and the like.

As shown in FIG. 4B, the back panel (410) of the coupling pouch (135) includes one or more strips of coupling material (420). According to one exemplary embodiment the one or more strips of coupling material (420) are configured to interact with the coupling board (130) of the bi-fold door (110), thereby securely coupling the coupling pouch to the coupling board. According to one exemplary embodiment, this allows a user to selectively couple the coupling pouch (135) to the coupling board (130) as needed. According to one exemplary embodiment, the one or more strips of coupling material (420) may include, but are in no way limited to, Velcro strips, adhesive strips, and/or magnets. As illustrated in FIGS. 1A-1E, the coupling pouch (135) allows a user to arrange any number of storage solutions and configurations depending on their perceived needs.

In conclusion, the present exemplary scrapbook or photo album workstation is configured to provide adequate storage solutions and workspace location while minimizing storage space requirements. Specifically, according to one exemplary embodiment, the present exemplary system and method includes a base workstation member including a plurality of adjustable shelves and a plurality of rabbits or protrusions to allow for a bi-fold door system. This allows for compact storage when in a closed position. Additionally, as mentioned previously, the coupling and configuration of the bi-fold doors allows for an expansive storage wall or vertical space to be compactly stored when not in use. Furthermore, the present exemplary system and method includes a plurality of adjustable shelves configured for space-efficient storage, shipping and use. Additionally, a collapsible table is coupled to the base workstation member to provide a useable workspace when in an opened position and folding to provide compact storage.

The preceding description has been presented only to illustrate and describe embodiments of the present scrapbook workstation. It is not intended to be exhaustive or to limit the invention to any precise form disclosed. Many modifications and variations are possible in light of the above teaching.

What is claimed is:

1. A compact workstation, comprising:

a base workstation member including a bottom member, a plurality of side members, and a top member all joined at right angles, wherein said top member and said bottom member have a first depth dimension and wherein said plurality of side members have a second depth dimension, said second depth dimension being larger than said first depth dimension, wherein said plurality of side members each form at least one protrusion extending a distance equal to said first depth dimension subtracted from said second depth dimension out from said base workstation an entire length of said plurality of side members, and wherein said base workstation member further includes a first plurality of adjustable shelves;

at least one bi-fold door rotatably coupled to each of said at least one protrusion of said base workstation, wherein said at least one bi-fold door includes a first panel and a second panel, said first panel and said second panel each having a length substantially equal to said length of said side members, wherein said first panel is rotatably coupled on a first side to said at least one protrusion of said base workstation, said first panel being configured to accept and support a second plurality of adjustable shelves, and wherein said second panel is rotatably coupled to a second side of said first panel, wherein said second panel includes a pouch coupling surface formed on at least one side of said second panel, said second panel having a width substantially equal to said distance said at least one protrusion extends from said base workstation; and a collapsible table rotatably coupled to said base workstation member, wherein said collapsible table is configured to be rotated from a vertical position to a horizontal position;

wherein when said compact workstation is in a closed position, said second panel of said at least one bi-fold door is rotated such that said pouch coupling surface is rotated adjacent to said first panel and said bi-fold door is rotated such that said second panel is adjacent to said top member and said bottom member of said base workstation; and wherein a front surface of said compact workstation is free of hinges when in said closed configuration.

2. The workstation of claim 1, wherein said base workstation further comprises a plurality of wheels disposed on a bottom portion of said base workstation member.

3. The workstation of claim 1, further comprising a plurality of collapsible bins disposed on said first and said second plurality of adjustable shelves.

4. The workstation of claim 3, wherein said plurality of collapsible bins each comprises: a collapsible base member including a plurality of side panels, a front panel, and a collapsible bottom including a joining seam; and a planar structural bottom panel configured to be disposed in said collapsible base member.

5. The workstation of claim 4, wherein said collapsible base further comprises: a handle disposed on said front panel; and a label pouch disposed on said front panel;

wherein said front panel is constructed of a transparent material.

6. The workstation of claim 4, wherein said collapsible base is configured to be folded into a planar form about one or more unions of said side panels when said joining seam is split.

7. The workstation of claim 1, wherein said pouch coupling surface formed on said second panel of said at least one bi-fold door comprises a hook-and-loop panel.

8. The workstation of claim 1, wherein said pouch coupling surface formed on said second panel of said at least one bi-fold door comprises a metallic panel configured to interact with a magnetic pouch.

9. The workstation of claim 7, further comprising a plurality of coupling pouches configured to be removably coupled to said coupling board formed on a second panel of said bi-fold door, wherein said plurality of coupling pouches includes a hook and loop material.

10. The workstation of claim 8, further comprising a plurality of coupling pouches configured to be removably coupled to said coupling board formed on a second panel of said bi-fold door, wherein said plurality of coupling pouches includes at least one magnet.

11. The workstation of claim 1, wherein said workstation is in the form of an armoire.

12. A compact workstation, comprising:

a base workstation member including a bottom member, a plurality of side members, and a top member all joined at right angles, wherein said top member and said bottom member have a first depth dimension and wherein said plurality of side members have a second depth dimension, said second depth dimension being larger than said first depth dimension, wherein said plurality of side members each form at least one protrusion extending a distance equal to said first depth dimension subtracted from said second depth dimension out from said base workstation an entire length of said plurality of side members, and wherein said base workstation member further includes a first plurality of adjustable shelves;

at least one bi-fold door rotatably coupled to each of said at least one protrusion of said base workstation, wherein said at least one bi-fold door includes a first panel and a second panel, said first panel and said second panel each having a length substantially equal to said length of said side members, wherein said first panel is rotatably coupled on a first side to said at least one protrusion of said base workstation, said first panel being configured to accept and support a second plurality of adjustable shelves, and wherein said second panel is roatably coupled to a second side of said first panel, wherein said second panel includes a pouch coupling surface formed on at least one side of said second panel, said second panel having a width substantially equal to said distance said at least one protrusion extends from said base workstation, wherein a depth of said second panel is shorter than a depth of said first panel a distance equal to a width of said plurality of side members;

a collapsible table rotatably coupled to said base workstation member;

a plurality of wheels disposed on a bottom portion of said base workstation member; and a plurality of collapsible bins disposed on said first and said second plurality of adjustable shelves.

13. The workstation of claim 12, wherein said plurality of collapsible bins each comprises: a collapsible base member including a plurality of side panels, a front panel, and a collapsible bottom including a joining seam; and a planar structural bottom panel configured to be disposed in said collapsible base member.

14. The workstation of claim 13, wherein said collapsible base further comprises: a handle disposed on said front panel; and a label pouch disposed on said front panel;

wherein said front panel is constructed of a transparent material.

15. The workstation of claim 13, wherein said collapsible base is configured to be folded into a planar form about one or more unions of said side panels when said joining seam is split.

16. The workstation of claim 12, wherein said pouch coupling surface formed on said second panel of said at least one bi-fold door comprises a hook-and-loop panel.

17. The workstation of claim 16, further comprising a plurality of coupling pouches configured to be removably coupled to said coupling board formed on a second panel of said bi-fold door, wherein said plurality of coupling pouches includes a hook and loop material.

18. The workstation of claim 12, wherein said pouch coupling surface formed on said second panel of said at least one bi-fold door comprises a metallic panel configured to interact with a magnetic pouch.

19. The workstation of claim 18, further comprising a plurality of coupling pouches configured to be removably coupled to said coupling board formed on a second panel of said bi-fold door, wherein said plurality of coupling pouches includes at least one magnet.

20. A compact workstation, comprising:

a base workstation member including a bottom member, a plurality of side members, and a top member all joined at right angles, wherein said top member and said bottom member have a first depth dimension and wherein said plurality of side members have a second depth dimension, said second depth dimension being larger than said first depth dimension, wherein said plurality of side members each form at least one protrusion extending a distance equal to said first depth dimension subtracted from said second depth dimension out from said base workstation an entire length of said plurality of side members, and wherein said base workstation member further includes a first plurality of adjustable shelves;

at least one bi-fold door rotatably coupled to each of said at least one protrusion of said base workstation, wherein said at least one bi-fold door includes a first panel and a second panel, said first panel and said second panel each having a length substantially equal to said length of said side members, wherein said first panel is rotatably coupled on a first side to said at least one protrusion of said base workstation, said first panel being configured to accept and support a second plurality of adjustable shelves, and wherein said second panel is roatably coupled to a second side of said first panel, wherein said second panel includes a pouch coupling surface formed on at least one side of said second panel, said second panel having a width substantially equal to said distance said at least one protrusion extends from said base workstation, wherein a depth of said second panel is shorter than a depth of said first panel a distance equal to a width of said plurality of side members;

a collapsible table rotatably coupled to said base workstation member;

a plurality of wheels disposed on a bottom portion of said base workstation member; and a plurality of collapsible bins disposed on said first and said second plurality of adjustable shelves, wherein said plurality of collapsible bins each includes a collapsible base member including a plurality of side panels, a transparent front panel, a collapsible bottom including a joining seam, a handle disposed on said front panel, a label pouch disposed on said front panel, and a planar structural bottom panel configured to be disposed in said collapsible base member;

wherein a height of said at least one protrusion is substantially equivalent to a width of said second panel.

* * * * *